US005154651A

United States Patent [19]

Binversie et al.

[11] Patent Number: 5,154,651

[45] Date of Patent: Oct. 13, 1992

[54] MARINE PROPULSION DEVICE TILT TUBE

[75] Inventors: Gregory J. Binversie, Grayslake; James E. Macier, Beach Park; John A. Pierman, Waukegan, all of Ill.; Joseph E. Capodarco, Kenosha, Wis.; David J. Hall, Zion, Ill.

[73] Assignee: Outboard Marine Corporation, Waukegan, Ill.

[21] Appl. No.: 526,044

[22] Filed: May 18, 1990

[51] Int. Cl.[5] ..... B63H 5/12

[52] U.S. Cl. ..... 440/63

[58] Field of Search ..... 114/144 R; 440/53, 57, 440/58-63; 74/500.1, 501.2, 502

[56] References Cited

U.S. PATENT DOCUMENTS

| | | | |
|---|---|---|---|
| 3,207,117 | 9/1965 | Nolen | 440/62 |
| 4,735,165 | 4/1988 | Baba et al. | 440/62 R |
| 4,744,777 | 5/1988 | Ferguson | 440/63 |
| 4,815,994 | 3/1989 | Hickham, Jr. | 440/62 |

*Primary Examiner*—Jesûs D. Sotelo

*Attorney, Agent, or Firm*—Michael, Best & Friedrich

[57] ABSTRACT

An outboard motor comprising a transom bracket which is adapted to be mounted on the transom of a boat and which includes first and second generally horizontally spaced apart portions, a tilt tube which extends through the transom bracket portions and along a generally horizontal tilt axis and which includes a first end portion extending outwardly of the first transom bracket portion and a second end portion extending outwardly of the second transom bracket portion, a swivel bracket mounted on the tilt tube for pivotal movement relative to the transom bracket about the tilt axis, a propulsion unit mounted on the swivel bracket for common movement therewith about the tilt axis and for pivotal movement relative thereto about a generally vertical steering axis, the propulsion unit including a propeller shaft adapted to support a propeller, and a steering arm adapted to be connected to a remote steering system, and structure on both of the tilt tube end portions for permitting the remote steering system to be alternatively connected to the first end portion or to the second end portion.

15 Claims, 2 Drawing Sheets

MARINE PROPULSION DEVICE TILT TUBE

BACKGROUND OF THE INVENTION

The invention relates to marine propulsion devices. More particularly, the invention relates to outboard motors, and still more particularly to outboard motor tilt tubes.

A conventional outboard motor, such as the one disclosed in U.S. Pat. No. 4,710,141, comprises a transom or stern bracket mounted on the transom of a boat, and a tilt tube which is supported by the transom bracket and which extends along a generally horizontal tilt axis. Nuts threaded onto the opposite ends of the tilt tube prevent axial movement of the tilt tube relative to the transom bracket. A swivel bracket is mounted on the tilt tube for pivotal movement relative thereto about the tilt axis, and a propulsion unit is mounted on the swivel bracket for pivotal movement relative thereto about a generally vertical steering axis. A steering ram slidably housed within the tilt tube has one end connected to the steering arm of the propulsion unit via a power steering system, and has the opposite end connected to the core of a steering cable assembly. The sheath of the steering cable assembly is fixed to one end of the tilt tube by a nut threaded onto the end of the tilt tube.

A conventional tilt tube extends a certain distance beyond one side of the transom bracket, which distance is only long enough to enable a retaining nut to be threaded onto the end of the tilt tube, but not long enough to enable the sheath of a remote control cable to be connected to that end of the tilt tube. The other end of the tilt tube extends a sufficient distance beyond the transom bracket to enable a retaining nut to be threaded onto that end of the tilt tube and to enable a remote control cable sheath to be secured to that end of the tilt tube by an additional nut.

Attention is directed to the following U.S. patents:

| | | |
|---|---|---|
| Nolan | 3,207,117 | September 21, 1965 |
| Baba | 4,735,165 | April 5, 1988 |
| Hickham | 4,815,994 | March 28, 1989 |

SUMMARY OF THE INVENTION

The invention provides an outboard motor comprising a transom bracket which is adapted to be mounted on the transom of a boat and which includes first and second generally horizontally spaced apart sides, a tilt tube which extends through the transom bracket and along a generally horizontal tilt axis and which includes a first end portion extending outwardly of the first transom bracket side and a second end portion extending outwardly of the second transom bracket side, a swivel bracket mounted on the tilt tube for pivotal movement relative to the transom bracket about the tilt axis, a propulsion unit mounted on the swivel bracket for common movement therewith about the tilt axis and for pivotal movement relative thereto about a generally vertical steering axis, the propulsion unit including a propeller shaft adapted to support a propeller, and a steering arm adapted to be connected to a remote steering system, and means on both of the tilt tube end portions for permitting the remote steering system to be alternatively connected to the first end portion or to the second end portion.

The invention also provides an outboard motor comprising a transom bracket which is adapted to be mounted on the transom of a boat and which includes first and second generally horizontally spaced apart sides, and a generally vertical center plane, a tilt tube extending through the transom bracket and along a generally horizontal tilt axis which is generally perpendicular to the plane, the tilt tube including a first end located outwardly of the first transom bracket side and a second end located outwardly of the second transom bracket side, the ends being substantially equidistant from the plane, a swivel bracket mounted on the tilt tube for pivotal movement relative to the transom bracket about the tilt axis, and a propulsion unit mounted on the swivel bracket for common movement therewith about the tilt axis and for pivotal movement relative thereto about a generally vertical steering axis, the propulsion unit including a propeller shaft adapted to support a propeller.

The invention also provides an outboard motor comprising a transom bracket which is adapted to be mounted on the transom of a boat and which includes first and second generally horizontally spaced apart sides, a tilt tube extending through the transom bracket and along a generally horizontal tilt axis, the tilt tube including a first end located outwardly of and spaced a distance from the first transom bracket side, and a second end located outwardly of and spaced a distance substantially equal to the certain distance from the second transom bracket side, a swivel bracket mounted on the tilt tube for pivotal movement relative to the transom bracket about the tilt axis, and a propulsion unit mounted on the swivel bracket for common movement therewith about the tilt axis and for pivotal movement relative thereto about a generally vertical steering axis, the propulsion unit including a propeller shaft adapted to support a propeller.

The invention also provides an outboard motor comprising a transom bracket adapted to be mounted on the transom of a boat, a tilt tube extending through the transom bracket and along a generally horizontal tilt axis, means for preventing pivotal movement of the tilt tube relative to the transom bracket, the means including a projection located on one of the transom bracket and the tilt tube and a recess which is located on the other of the transom bracket and the tilt tube and which receives the projection, a swivel bracket mounted on the tilt tube for pivotal movement relative thereto about the tilt axis, and a propulsion unit mounted on the swivel bracket for common movement therewith about the tilt axis and for pivotal movement relative thereto about a generally vertical steering axis, the propulsion unit including a propeller shaft adapted to support a propeller.

A principal feature of the invention is the provision of an outboard motor construction that enables a remote steering system to be connected to either end of the tilt tube. The tilt tube extends a sufficient distance beyond both sides of the transom bracket to enable a remote steering system to be alternatively connected to either end of the tilt tube. Thus, the tilt tube does not have to be reversed in order to connect the steering system to the other end of the tilt tube.

Other features and advantages of the invention will become apparent to those skilled in the art upon review of the following detailed description, claims and drawings.

Figures 1, 2, 3:
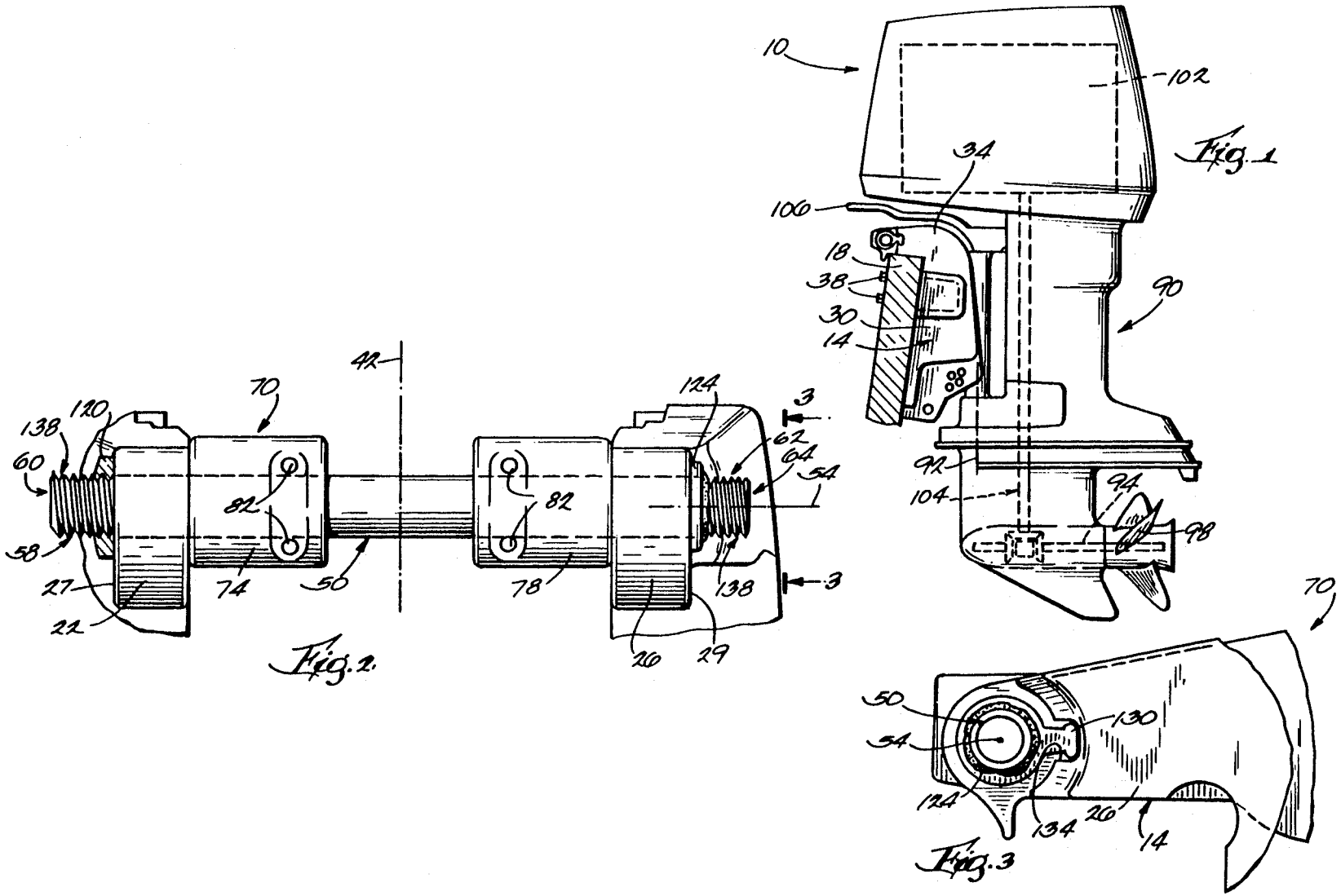
FIG. 1 is a side elevational view of a marine propulsion device embodying the invention.
FIG. 2 is an enlarged, partial front elevational view of the marine propulsion device.
FIG. 3 is a view taken along line 3—3 in FIG. 2.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. While the illustrated marine propulsion device is an outboard motor, it should be understood that the invention is applicable to other types of marine propulsion devices.

The marine propulsion device 10 comprises (see FIG. 1) a transom or stern bracket 14 mounted on the transom 18 of a boat. The transom bracket 14 includes (see FIGS. 2 and 4) first and second or left and right generally horizontally spaced-apart portions 22 and 26, respectively. The transom bracket portion 22 defines (see FIG. 2) a left side 27 of the transom bracket 14, and the transom bracket portion 26 defines a right side 29 of the transom bracket 14. In the illustrated construction, each of the transom bracket portions 22 and 26 includes (see FIG. 1) a generally vertically extending section 30 abutting the rearward surface of the transom 18, and a generally horizontally extending section 34 abutting the upper surface of the transom 18. The transom bracket 14 also includes (see FIG. 2) a generally vertical center plane 42 located centrally between the transom bracket portions 22 and 26. Preferably, each of the transom bracket portions 22 and 26 is secured to the transom 18 by a plurality of bolts or screws 38 (FIG. 1) extending through the transom 18. In the illustrated construction, the transom bracket portions 22 and 26 are separate castings that are fixed relative to each other primarily as a result of being fixed to the transom 18. In alternative constructions, the two transom bracket portions can be part of a single casting.

The marine propulsion device 10 also comprises (see FIGS. 2 and 4) a tilt tube 50 extending through the transom bracket portions 22 and 26 and along a generally horizontal tilt axis 54. The tilt tube 50 includes (see FIG. 2) a first or left end portion 58 extending outwardly of the left transom bracket portion 22 and including a first or left end 60 of the tilt tube 50. The tilt tube 50 also includes a second or right end portion 62 extending outwardly of the right transom bracket portion 26 and including a second or right end 64 of the tilt tube 50. In the illustrated construction, the left and right ends 60 and 64 of the tilt tube 50 are substantially equidistant from the center plane 42 of the transom bracket 14, and the length of the left end portion 58 of the tilt tube 50 is substantially equal to the length of the right end portion 62 of the tilt tube 50. In other words, the distance from the left side 27 of the transom bracket 14 to the left end 60 of the tilt tube 50 is substantially equal to the distance from the right side 29 of the transom bracket 14 to the right end 64 of the tilt tube 50.

The marine propulsion device 10 also comprises (see FIGS. 2 and 4) a swivel bracket 70 mounted on the tilt tube 50 for pivotal movement relative to the tilt tube 50 and relative to the transom bracket 14 about the tilt axis 54. In the illustrated construction, the swivel bracket 70 includes a pair of forwardly extending projections 74 and 78 through which the tilt tube 50 extends. The forward end of each projection 74 or 78 has therein (see FIG. 2) a pair of threaded apertures 82, the reason for which is explained below.

Figure 4:
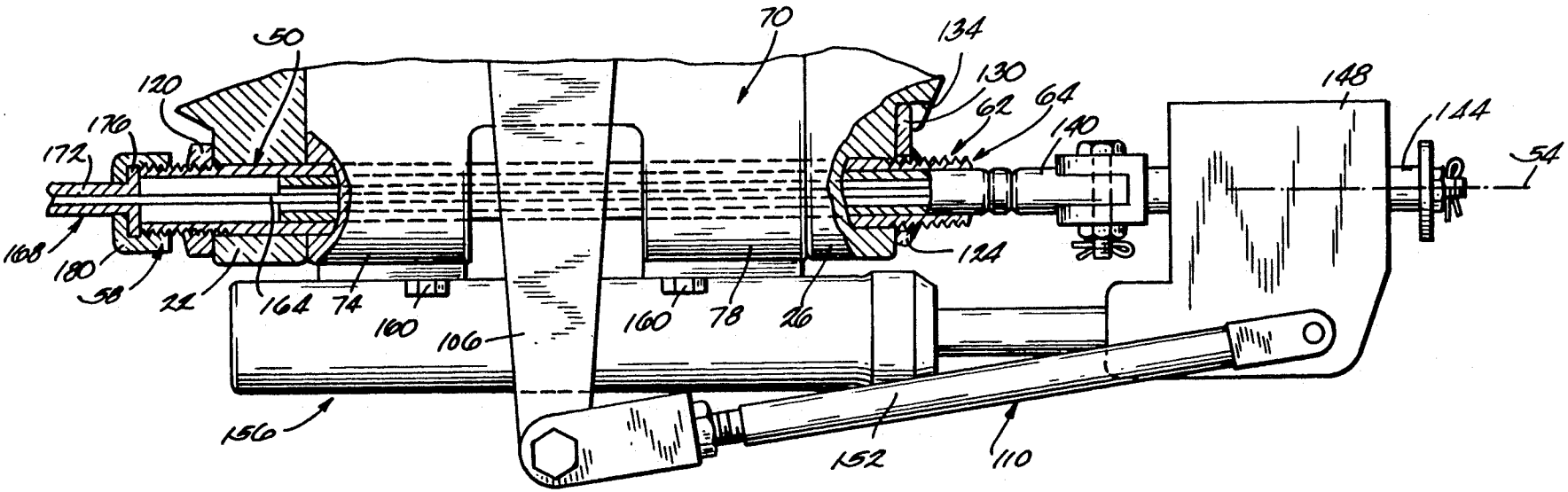
FIG. 4 is a partial plan view of the marine propulsion device with a power steering device attached.

The marine propulsion device 10 further comprises (see FIG. 1) a propulsion unit 90 mounted on the swivel bracket 70 for common movement therewith about the tilt axis 54 and for pivotal movement relative thereto about a generally vertical steering axis 92. The propulsion unit 90 includes a propeller shaft 94 supporting a propeller 98, and an engine 102 drivingly connected to the propeller shaft 94 by a conventional drive train 104. The propulsion unit 90 also includes a forwardly extending steering arm 106 adapted to be connected to the below-described remote steering system 110 (FIG. 4).

The marine propulsion device 10 also comprises means for preventing axial movement of the tilt tube 50 relative to the transom bracket 14. While various suitable means can be employed, in the illustrated embodiment, such means includes (see FIGS. 2 and 4) a first retaining member 120 fixed to the tilt tube 50 adjacent the left end 60 thereof and located outwardly of the left transom bracket portion 22. Preferably, the left retaining member 120 is a nut threaded onto the left end portion 58 of the tilt tube 50. The means for preventing axial movement of the tilt tube 50 also includes (see FIGS. 2–4) a second or right retaining member 124 fixed to the tilt tube 50 adjacent the right end 64 thereof and located outwardly of the right transom bracket portion 26. In the illustrated construction, the right retaining member 124 is an annular member welded to the right end portion 62 of the tilt tube 50.

The marine propulsion device 10 further comprises means for preventing pivotal movement of the tilt tube 50 relative to the transom bracket 14. While various suitable means can be used, in the illustrated construction, such means includes (see FIG. 3) a projection 130 located on the right retaining member 124 (and thus located on the tilt tube 50) and a recess 134 which is located on the right transom bracket portion 26 and which receives the projection 130. Engagement of the projection 130 with the transom bracket 14 facilitates connection of the tilt tube 50 to the transom bracket 14 as it prevents pivotal movement of the tilt tube 50 while the left retaining nut 120 is being threaded onto the left end portion 58 of the tilt tube 50.

The marine propulsion device 10 further comprises means on both of the tilt tube end portions 58 and 62 for permitting the remote steering system 110 to be alternatively connected to the left end portion 58 or to the right end portion 62 of the tilt tube 50. While various suitable means can be employed, in the illustrated construction, such means includes (see FIG. 2) external threads 138 on both of the tilt tube end portions 58 and 62. As shown in FIG. 2, the length of the threads 138 on the left end portion 58 is substantially equal to the length of the threads 138 on the right end portion 62.

The marine propulsion device also comprises (see FIG. 4) the above-mentioned remote steering system 110. The remote steering system 110 can have various suitable constructions. A suitable construction is disclosed in U.S. Pat. No. 4,710,141, which is incorporated herein by reference. The steering system 110 includes (see FIG. 4) a steering ram 140 slidably housed within the tilt tube 50. The right end of the steering ram 140 is connected to a spool valve 144 housed within a valve housing 148, and the valve housing 148 is connected to the steering arm 106 by a connecting link 152 so that lateral movement of the valve housing 148 causes steering movement of the steering arm 106. Lateral or axial movement of the steering ram 140 acts through the spool valve 144 and a hydraulic assembly 156, as disclosed in U.S. Pat. No. 4,710,141, to cause lateral movement of the valve housing 148. The hydraulic assembly 156 is preferably connected to the swivel bracket 70 by bolts 160 threaded into the apertures 82 in the swivel bracket 70.

The steering ram 140 is connected to the core 164 of a steering cable assembly 168 for common movement therewith. The steering cable assembly 168 also includes a sheath 172 which slidably houses the core 164 and which includes a flange 176 fixed to the left end 60 of the tilt tube 50 by a nut 180 threaded onto the left end portion 58 of the tilt tube 50.

The steering system 110 can be reversed, i.e., the steering cable assembly 168 can be connected to the right end portion 62 of the tilt tube 50, by reversing the orientation of the steering ram 140, the hydraulic assembly 156 and the connecting link 152 and by connecting the cable sheath 172 to the right end 64 of the tilt tube 50. It is not necessary to reverse the orientation of the tilt tube 50.

Various features of the invention are set forth in the following claims.

We claim:

1. An outboard motor comprising a transom bracket which is adapted to be mounted on the transom of a boat and which includes first and second generally horizontally spaced apart sides, a tilt tube which extends through said transom bracket and along a generally horizontal tilt axis and which includes a first end portion extending outwardly of said first transom bracket side and a second end portion extending outwardly of said second transom bracket side, a swivel bracket mounted on said tilt tube for pivotal movement relative to said transom bracket about said tilt axis, a propulsion unit mounted on said swivel bracket for common movement therewith about said tilt axis and for pivotal movement relative thereto about a generally vertical steering axis, said propulsion unit including a propeller shaft adapted to support a propeller, and a steering arm adapted to be connected to a remote steering system, means on both of said tilt tube end portions for permitting the remote steering system to be alternatively connected to said first end portion or to said second end portion, and means for preventing pivotal movement of said tilt tube relative to said transom bracket.

2. An outboard motor as set forth in claim 1 and further comprising means for preventing axial movement of said tilt tube relative to said transom bracket.

3. An outboard motor as set forth in claim 2 wherein said means for preventing axial movement of said tilt tube includes a first retaining member fixed to said first tilt tube end portion outwardly of said first transom bracket side, and a second retaining member fixed to said second tilt tube end portion outwardly of said second transom bracket side.

4. An outboard motor as set forth in claim 3 wherein said pivotal movement preventing means includes a projection located on one of said transom bracket and said tilt tube, and a recess which is located on the other of said transom bracket and said tilt tube and which receives said projection.

5. An outboard motor as set forth in claim 3 wherein said pivotal movement preventing means includes a projection located on one of said retaining members.

6. An outboard motor comprising a transom bracket which is adapted to be mounted on the transom of a boat and which includes first and second generally horizontally spaced apart sides and a generally vertical center plane, a tilt tube extending through said transom bracket and along a generally horizontal tilt axis which is generally perpendicularly to said plane, said tilt tube including a first end located outwardly of said first transom bracket side and a second end located outwardly of said second transom bracket side, said ends being substantially equidistant from said plane, a swivel bracket mounted on said tilt tube for pivotal movement relative to said transom bracket about said tilt axis, a propulsion unit mounted on said swivel bracket for common movement therewith about said tilt axis and for pivotal movement relative thereto about a generally vertical steering axis located in said centerplane, said propulsion unit including a propeller shaft adapted to support a propeller, and means for preventing pivotal movement of said tilt tube relative to said transom bracket.

7. An outboard motor as set forth in claim 6 wherein said pivotal movement preventing means includes a projection located on one of said transom bracket and said tilt tube, and a recess which is located on the other of said transom bracket and said tilt tube and which receives said projection.

8. An outboard motor as set forth in claim 6 and further comprising means for preventing axial movement of said tilt tube relative to said transom bracket.

9. An outboard motor as set forth in claim 8 wherein said means for preventing axial movement of said tilt tube includes a first retaining member fixed to said tilt tube adjacent said first end and located outwardly of said first transom bracket side, and a second retaining member fixed to said tilt tube adjacent said second end and located outwardly of said second transom bracket side.

10. An outboard motor as set forth in claim 9 wherein said pivotal movement preventing means includes a projection located on one of said retaining members.

11. An outboard motor comprising a transom bracket adapted to be mounted on the transom of a boat, a tilt tube extending through said transom bracket and along a generally horizontal tilt axis, means for preventing pivotal movement of said tilt tube relative to said transom bracket, a swivel bracket mounted on said tilt tube for pivotal movement relative thereto about said tilt axis, and a propulsion unit mounted on said swivel bracket for common movement therewith about said tilt axis and for pivotal movement relative thereto about a generally vertical steering axis, said propulsion unit including a propeller shaft adapted to support a propeller.

12. An outboard motor as set forth in claim 11 and further comprising means for preventing axial movement of said tilt tube relative to said transom bracket.

13. An outboard motor as set forth in claim 12 said tilt tube includes first and second end portions, wherein said transom bracket includes first and second generally horizontally spaced apart sides, wherein said means for preventing axial movement of said tilt tube includes a first retaining member fixed to said first tilt tube end portion outwardly of said first transom bracket side, and a second retaining member fixed to said second tilt tube end portion outwardly of said second transom bracket side.

14. An outboard motor as set forth in claim 13 wherein said pivotal movement preventing means includes a projection located on one of said retaining members.

15. An outboard motor as set forth in claim 11 wherein said pivotal movement preventing means includes a projection located on one of said transom bracket and said tilt tube, and a recess which is located on the other of said transom bracket and said tilt tube and which receives said projection.

* * * * *